US006308899B1

(12) United States Patent
Crofford

(10) Patent No.: US 6,308,899 B1
(45) Date of Patent: Oct. 30, 2001

(54) MULTI-MODE FLUID INJECTION SYSTEM

(76) Inventor: Joe Crofford, 742 Mokulua Dr., Kailua, HI (US) 96734

( * ) Notice: Subject to any disclaimer, the term of this patent is extended or adjusted under 35 U.S.C. 154(b) by 0 days.

(21) Appl. No.: 09/620,329

(22) Filed: Jul. 20, 2000

(51) Int. Cl.[7] ..... B05B 9/04; B05B 15/06

(52) U.S. Cl. ..... 239/373; 239/436; 239/525; 239/532

(58) Field of Search ..... 239/152–154, 239/195, 337, 373, 375, 436, 525, 526, 532, 288.5; 222/173, 184, 538; 134/166 C, 166 R, 167 R; 15/406; 4/255.06, 255.05, 255.04, 255.01; 138/90; 248/79, 90, 75, 89

(56) References Cited

U.S. PATENT DOCUMENTS

| | | | | |
|---|---|---|---|---|
| 1,209,599 | * | 12/1916 | Le Favre . | |
| 1,236,712 | | 8/1917 | Hitchcock . | |
| 1,745,923 | | 2/1930 | Frizzel . | |
| 1,750,512 | * | 3/1930 | Ewald . | |
| 1,769,061 | | 7/1930 | Hitchcock . | |
| 1,821,900 | | 9/1931 | Silvers . | |
| 1,979,135 | * | 10/1934 | Altenburger et al. . | |
| 1,994,526 | | 3/1935 | McCloskey . | |
| 2,052,563 | | 9/1936 | Gould . | |
| 2,059,785 | | 11/1936 | Gaik . | |
| 2,267,064 | | 12/1941 | Wikelund . | |
| 3,002,698 | | 10/1961 | Gallo . | |
| 4,192,464 | | 3/1980 | Chow . | |
| 4,570,855 | | 2/1986 | Johnston . | |
| 5,031,839 | * | 7/1991 | Waldrum | 239/525 X |
| 5,186,391 | | 2/1993 | Roueche et al. . | |
| 5,263,646 | * | 11/1993 | McCauley | 239/154 |
| 5,416,947 | | 5/1995 | Jaffe . | |
| 5,649,664 | | 7/1997 | Brass . | |
| 5,884,842 | * | 3/1999 | Caine et al. | 239/288.5 X |
| 5,966,847 | * | 10/1999 | Natheson et al. | 239/532 X |

* cited by examiner

*Primary Examiner*—Lesley D. Morris
(74) *Attorney, Agent, or Firm*—Seth M. Reiss

(57) ABSTRACT

A compact, highly portable, multi-mode fluid injection system able to reach difficult to access places to efficiently service a variety of diameter pipes, tubing and related components. The system comprises a tank having a first port which allows access to the tank's upper contents and a second port which allows access to the tank's lower contents, a means for introducing liquid into the tank, a hand pump built into the tank to pressurize the tank and its contents, one or more applicators, and flexible hoses which connect the applicators to the first and/or second port to supply the applicators with the tank's contents. The system is capable of producing, alternatively, pressurized liquid or gas without an independently powered air compressor or consumable gas cartridges, and without having to empty and/or fill the tank. An onboard means for stowing the hose conduits, an injection gun applicator having a small travel-high flow valve with adjustable accumulation chamber, and applicators having stiff-flexible tips and tip extensions are also described.

18 Claims, 7 Drawing Sheets

MULTI-MODE FLUID INJECTION SYSTEM

BACKGROUND OF INVENTION

RELATED PATENT APPLICATIONS

There are no related patent applications.

FIELD OF INVENTION

The present invention relates generally to pressurized injection systems used to unclog, clean and service pipes, tubing and related equipment. More particularly, this invention, describes a compact, highly portable, high pressure fluid injection system able to reach difficult to access places to efficiently service a variety of diameter pipes and tubing.

DESCRIPTION OF THE PRIOR ART

Field work in the air conditioning and plumbing business requires a variety of rugged but light weight tools. Performance demands on these tools are high as they directly affect the productivity of high cost professionals.

There exists a wide variety of commercially available apparatus regularly used to unclog, clean and otherwise maintain plumbing and appliances comprised of pipes and tubing. Many such apparatus are large and/or heavy, difficult to carry and of limited use in servicing pipes and tubing located in remote or difficult to reach places.

It is a primary object of the present invention to provide a durable apparatus for cleaning pipes and tubing which is light, compact, and highly portable, and that can be used to easily service pipes and tubing including those not immediately accessible.

Commercially available equipment rely extensively upon compressed air to inject pressurized liquid and gas into and around pipes, tubing and related components. Compressed air is typically supplied through independently powered air compressors or via gas cartridges. Air compressors and gas cartridges reflect an additional expense to the plumbing and air conditioning service industry. Moreover, air compressors are heavy, noisy, and require an independent power source that severely restricts the mobility of the field worker, while gas cartridges represent an additional consumable supply which must accompany the field worker on all jobs.

It is a further object of the present invention to provide an apparatus for cleaning pipes and tubing that functions by injecting pressurized gas and liquid into and around pipes and tubing without the limitations or expense consequent to the use of independently powered air compressors or gas cartridges.

Among the pertinent prior art are compact apparatus designed to inject compressed air and spray pressurized liquid to unclog pipes and tubing. Such apparatus are generally specific for either air or liquid. Those apparatus that accommodate both liquid and gas modalities must be emptied and/or filled in order to change between modes. Service personnel desiring to apply, alternatively, pressurized air and liquid to service pipes and tubing using presently available equipment must have available one apparatus per compressed mode, or must empty and/or fill the apparatus between modes.

A further object of the subject invention is to provide service personnel with the ability to inject either or both compressed liquid and compressed air using a single, light weight, apparatus, without the need to empty or fill the apparatus between modalities.

Fluid injection systems include sizable lengths of hose to transport pressurized liquid and gas to spray applicators. When not in use, the hose dangle free. Free dangling hose typically becomes caught on and tangled with other equipment, drags along the ground during transport, and is particular prone to damage.

A further object of the claimed invention is to provide a compact injection system which includes onboard storage for the flexible hoses to facilitate transport of the system and prevent tangling and damage to the hose.

It is still a further object of the subject invention to provide a multi-mode fluid injection system having a gun applicator capable of injecting small volumes of liquid or compact blasts of air at relative high pressure and velocity to small, hard to reach areas of pipes, tubing and related equipment.

Yet another object of the subject invention is to provide a multi-mode injection system having applicators that can efficiently address a diverse range of shaped and sized tubing as well as tubing accessible only from specific pre-defined distances and angles.

SUMMARY OF THE INVENTION

These and other objects are accomplished in the present invention, a multi-mode fluid injection system comprising a tank having a first port which allows access to the tank's upper contents and a second port which allows access to the tank's lower contents, a means for introducing liquid into the tank, a hand pump built into the tank to pressurize the tank and its contents, one or more applicators, and flexible hoses which connect the applicators to the first and/or second port to supply the applicators with the tank's contents. Among the invention's preferred embodiments are systems which employ specialized injection gun and sprayer wand applicators capable of supplying small volumes of liquid and gas at high pressure and velocity, systems having applicators with stiff, flexible tips that can access and effectively shoot difficult to access pipes and tubing, and systems which include onboard means for stowing the flexible hoses in order to prevent tangling and damage to the hoses during transport and stowage.

The small size and weight of the apparatus of the present invention allow a great degree of portability and facilitates its use in hard to reach locations. The tank is pressure rated to withstand the moderate pressures introduced by hand pumping, and includes a safety valve and an optional pressure gauge. The ergonomic form of the tank promotes ease of use and includes a concave base extension which accommodates stowage of the flexible hose.

Applicators are detachably coupled to one of the two tank ports through quick connect fittings or comparable commercially available coupling methods. The port which makes available the upper tank contents supplies applicators with gas under pressure, while the port which makes available the lower tank contents supplies the applicators with pressurized liquid.

The fluid injection gun applicator of the present invention embodies a balanced light weight design having a small travel-high flow valve, a stiff but readily adjustable nozzle tube, a unique accumulation chamber after the valve, readily replaceable nozzles, and a proven conical sealing adaptor for connecting to varying size openings when used in internal passage cleaning The wand sprayer applicator of the present invention similarly embodies an ergonomic design and includes a stiff but flexible wand tips of varying length in order to efficiently address difficult to access pipes and tubing coils having a range of diameters.

The operation of the multi-mode fluid injection system of the present invention is briefly described in the following. A liquid, which may be water or a cleaning solution of some sort, is introduced into the tank. The hand pump, built into the tank, is hand activated and pressurizes the tank. Depending on the mode of operation, liquid, gas, or both, one or two hoses are quick coupled to the appropriate port fitting and to the selected applicators. The applicator is moved into position and the flexible nozzle bent as required in order to allow access to the furthest reaches of complicated equipment.

Actuation of fluid injection is enabled by the hand operated applicator valve. In the case of the injection gun applicator, the pumped fluid first fills the post-valve chamber and then exits the nozzle at high velocity and pressure. Alternatively, the wand applicator is be used in a similar manner and, like the injection gun, for both liquid or gas injection. The wand applicator, with its length adjustable and stiff but highly flexible tip, is particularly well suited for spraying difficult to access areas as, for example, fins and radiators on the back side of equipment. Both applicators can employ the same tip attachments, being the stiff-flexible tip extensions and conical sealing adaptors.

Further objects and advantages of this invention will become apparent from consideration of the drawings and ensuing description.

BRIEF DESCRIPTION OF THE DRAWINGS

The details of typical, but not limiting, embodiments of the present invention will be described in connection with the accompanying drawings.

DETAILED DESCRIPTION OF THE PREFERRED EMBODIMENTS

Figure 1:
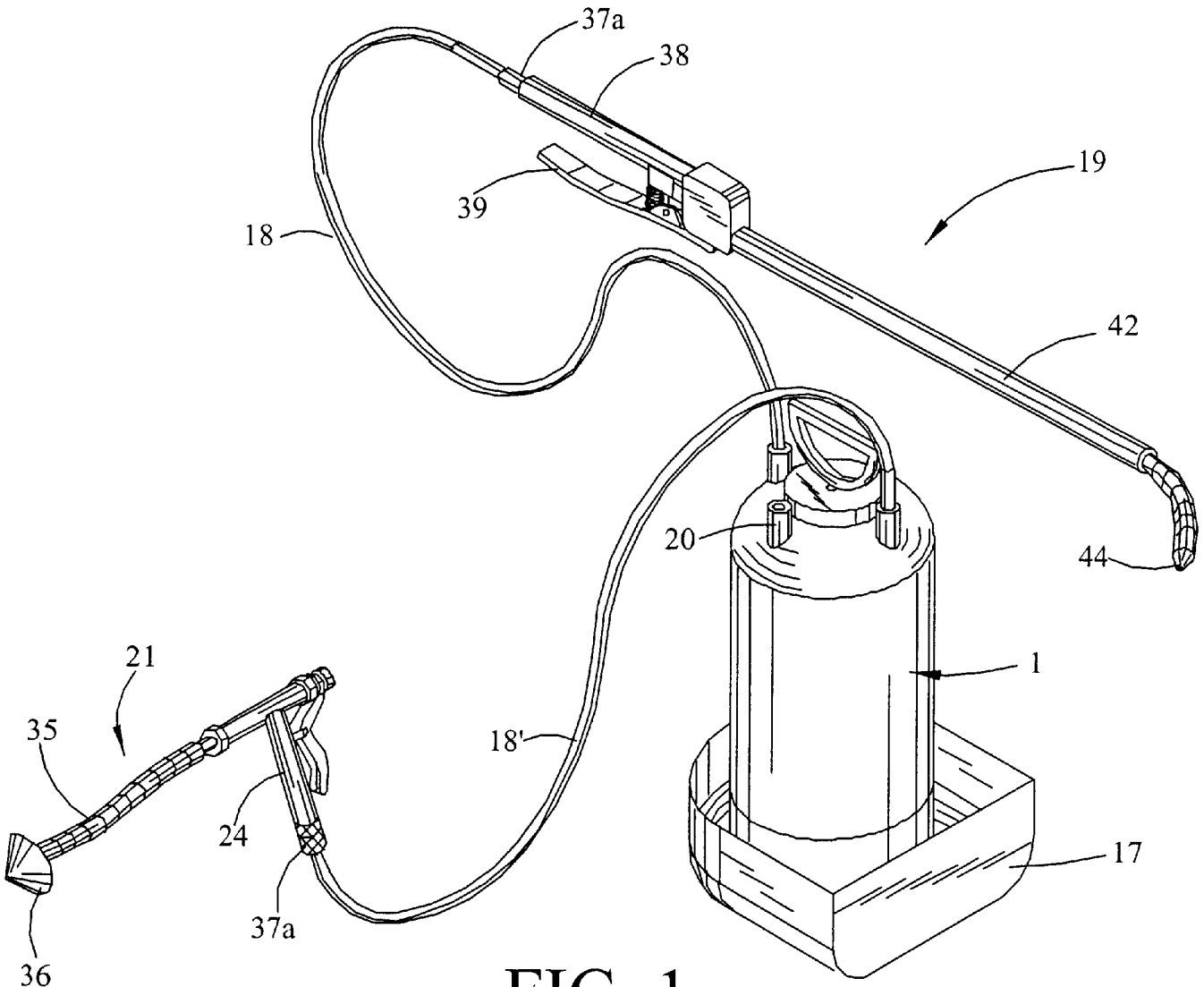
FIG. 1 is a perspective view of a fluid injection system of the present invention showing the tank, injection gun and wand sprayer.

A preferred embodiment of the multi-mode fluid injection apparatus of the present invention is illustrated in FIG. 1, comprising a tank 1, a sprayer wand applicator 19, and an injection gun applicator 21. A pressure relief valve 20 is formed into and extends from the top of tank 1. A concave base extension 17 attaches to and projects upward from the base of tank 1 to surround the lower portion of tank 1. According to the embodiment depicted in FIG. 1, base extension 17 is generally round but adapted with a flat side to facilitate tank 1 being laid on its side during storage or use.

Grossly, wand sprayer applicator 19 is comprised of a sprayer body 38, a sprayer actuator 39, a sprayer tube 42, and a stiff-flexible wand tip 44. Applicator 19 communicates with tank 1 through a hose 18. One end of hose 18 is removably attached to wand applicator 19 through a quick release fitting 37*a* built onto the base of applicator 19. The opposite end of hose 18 is removably attached to tank 1.

Grossly, injection gun applicator 21 is comprised of a gun handle 24, stiff-flexible gun tube 35, and a conical tip 36. Gun applicator 21 communicates with tank 1 through a second hose 18'. One end of hose 18' is removably attached to gun applicator 21 through quick release fitting 37*a* built onto the base of gun handle 24. The opposite end of hose 18' is removably attached to tank 1.

Figure 4:
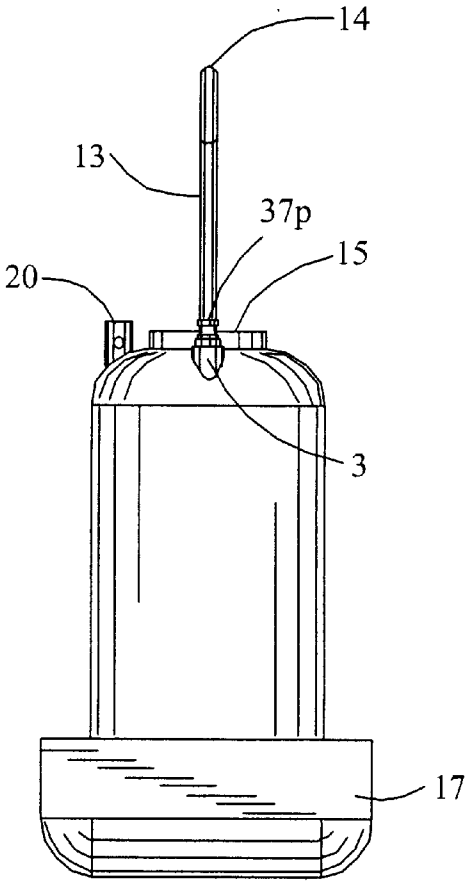
FIG. 4 is further side view of the tank of the present invention rotated 90 degrees relative to the FIG. 3.
Figure 3:
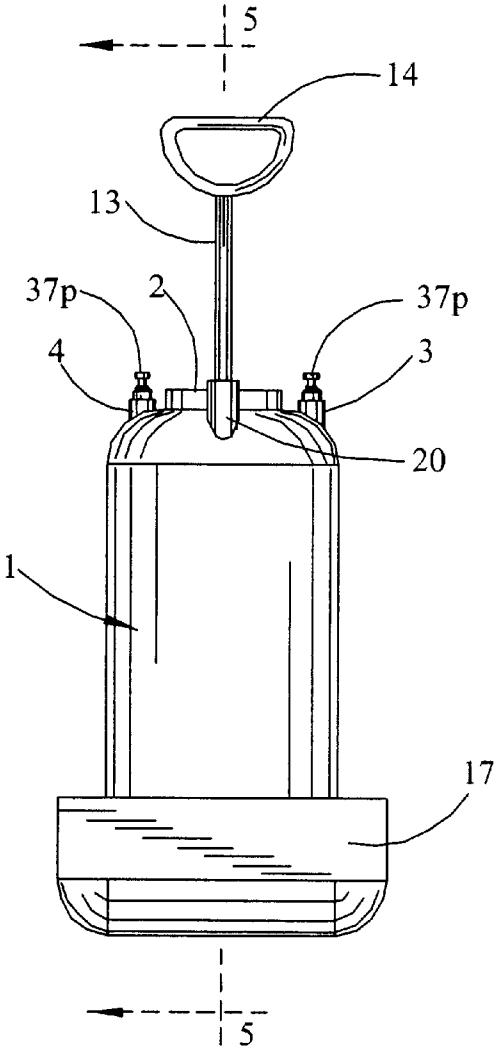
FIG. 3 is a side view of the tank of the present invention.
Figure 2:
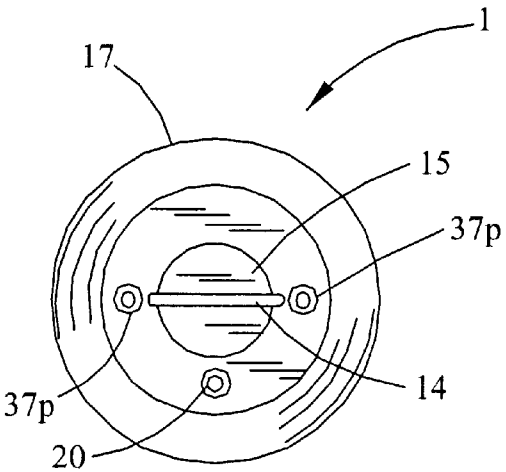
FIG. 2 is a top plan view of the tank of the present invention.

External details of tank 1 of the present invention are depicted in FIGS. 2, 3 and 4, being tank 1 top and side views, respectively. Tank 1 is pressure rated and is formed with a large center tank aperture 2. Tank aperture 2 allows for the introduction of liquid after which tank 1 is sealed using a screw-on cap 15. Two ports, an air port 3 and a liquid port 4, project from the top of tank 1, one on either side of aperture 2. Hoses 18 and 18' attach to tank 1 as shown in FIG. 1 through two quick release fittings 37*p,* which are affixed to and extend from the top of ports 3 and 4 respectively. Relief value 20 also projects from the top of tank 1 spaced apart from ports 3 and 4.

A pump shaft 13 extends from the center top of tank 1, and a pump handle 14 is mounted on the top of shaft 13. Concave base extension 17, depicted here without a flat side, is secured symmetrically to encircle the base of tank 1.

The internal components and configuration of tank 1 are described with reference to FIG. 5, a cross-sectional view of tank 1 taken along line 5—5 in FIG. 3. Quick release fittings 37*p,* capping air port 3 and liquid port 4 and projecting from the top of tank 1, are used to connect to hoses 18 and 18' and then to either wand sprayer applicator 19 or injection gun applicator 21. Air port 3, which provides access to the contents of the uppermost portion of tank 1, supplies pressurized air as the fluid injection medium to the wand applicator 19 or gun applicator 21.

Port 4 is found opposite port 3 on the top of tank 1. Secured to the bottom of port 4 is a tube 5. Tube 5 extends inside tank 1 downward from port 4 to the bottom of tank 1. When in use, the bottom of the tank 1 contains a liquid, typically water or a cleaning solution of some sort. The liquid is supplied at tank pressure to gun applicator 21 or wand applicator 19 through tube 5 and port 4 to either hose 18' (if the injection gun applicator 21 is to be used) or hose 18 (if wand sprayer applicator 19 is to be used).

Figure 5:
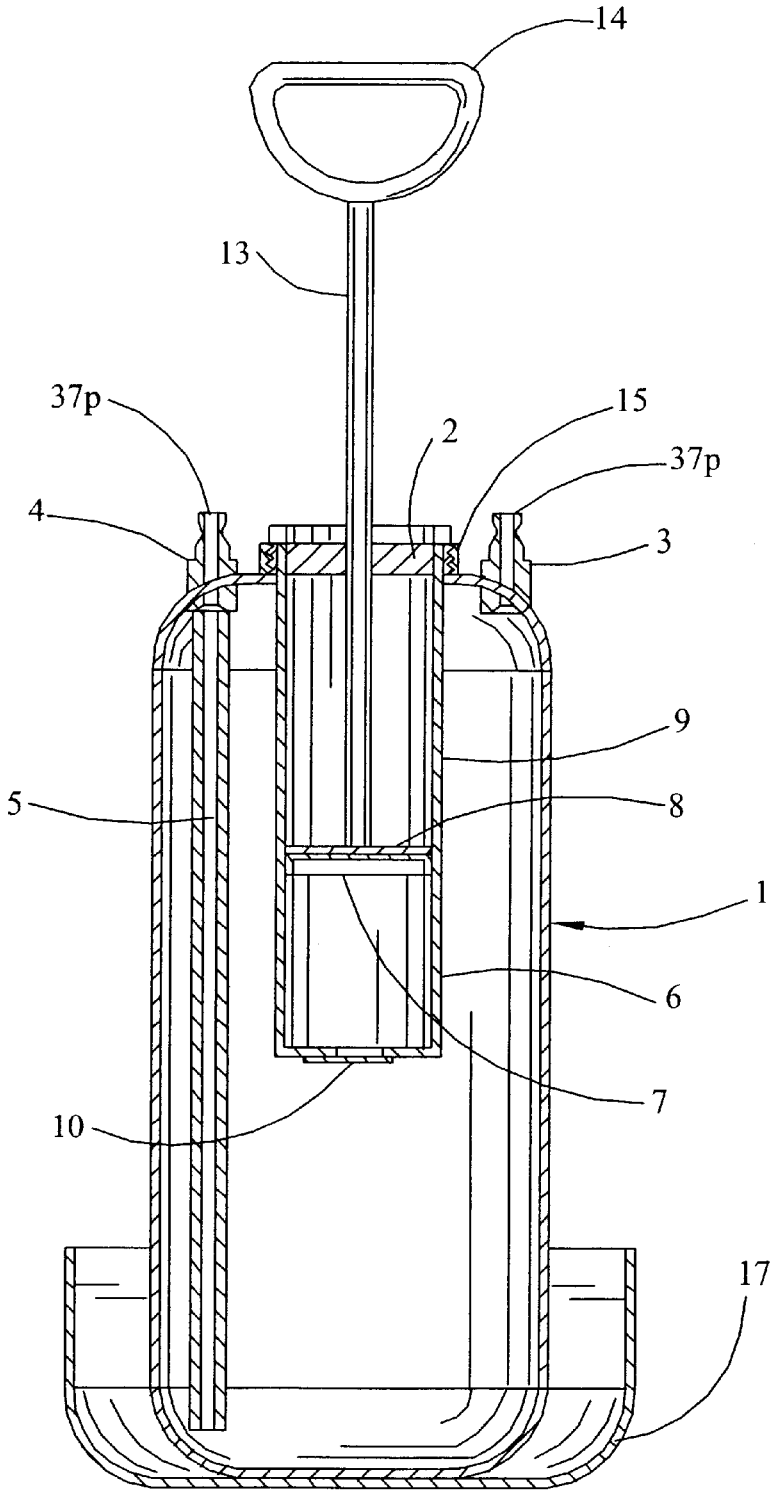
FIG. 5 is a cross-sectional view of the tank of the present invention taken along line 5—5 in FIG. 3.

Also depicted in FIG. 5 are the internal components of the hand pump used to supply the contents of tank 1 with pressure. A variety of known hand pumps can be utilized in aperture 2. The conventional hand pump depicted in FIG. 5 comprises pump handle 14, pump shaft 13, a cylinder housing 9, a piston 7 secured to the bottom of shaft 13 capped with one or more cup type seals 8, and a bottom check valve 10. Pump handle 14 is ergonomically shaped for comfort and efficiency. All described components of the hand pump are secured in place relative to one another and within aperture 2 by screw cap 15.

As will be clear to those in the industry, the contents of tank 1 are pressurized by grasping and pumping handle 14, causing piston 7 to compress and force the air in cylinder housing 9 through check valve 10. Check valve 10 functions to allow air into the chamber of tank 1 but not out. Other known pump components, as for example a relief valve, are not shown but can be employed.

FIG. 5 illustrates concave base extension 17 extending upward from the base of tank 1 and encircling the lower portion thereof. The cavity between extension 17 and the sidewall of tank 1 serves as a hose carrier to stow hoses 18 and 18' when not in use, while the manner in which extension 17 extends the diameter of the base of tank 1 serves to stabilize tank 1 particularly when utilizing the hand pump to pressurize the system. Extension 17 also serves as a secondary reservoir that protects against the escape of corrosive chemicals that may result from tank leaks or spills. By catching caustic and toxic chemicals, as for example industrial chemicals comnmonly used to clean air conditioning coils, extension 17 prevents damage to floor surfaces and increases worker safety.

Details of a preferred embodiment of injection gun applicator 21 are shown in FIGS. 6 through 9. Hose 18' is a flexible hose capable of withstanding high pressures, having quick connect fittings at both ends. The length of hose 18' varies considerably depending upon the intended use, but in general measures approximately 12 feet. Hose 18' connects to gun handle 24 through quick connect fitting 37*a*. According to the preferred embodiment of gun applicator 21 depicted, inlet connect fitting 37*a* extends straight out from the base of a gun handle 24 such that, when attached, hose 18' demonstrates an in-line orientation with gun handle 24. Other orientations of hose 18' to gun handle 24 are possible, including for example, a right angle orientation, in order to facilitate usage of gun applicator 21 in tight places and hard to reach corners. Though not shown, handle 24 may have one or more grip enhancing surfaces and may be textured to further promote firm gripping.

Figure 6:
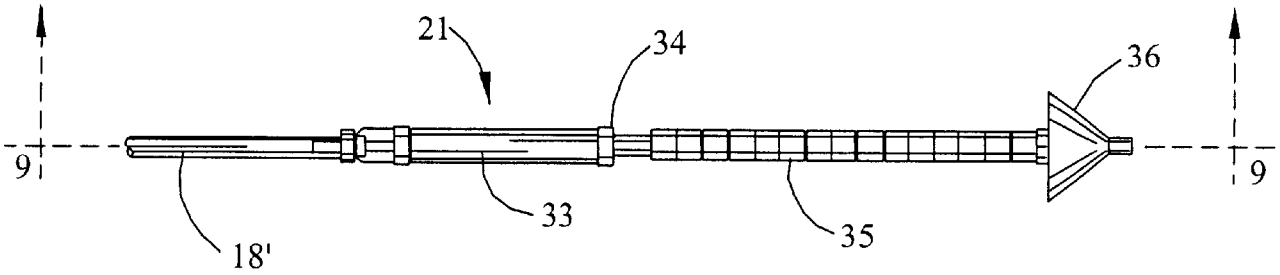
FIG. 6 is a top plan view of a injection gun applicator.
Figure 7:
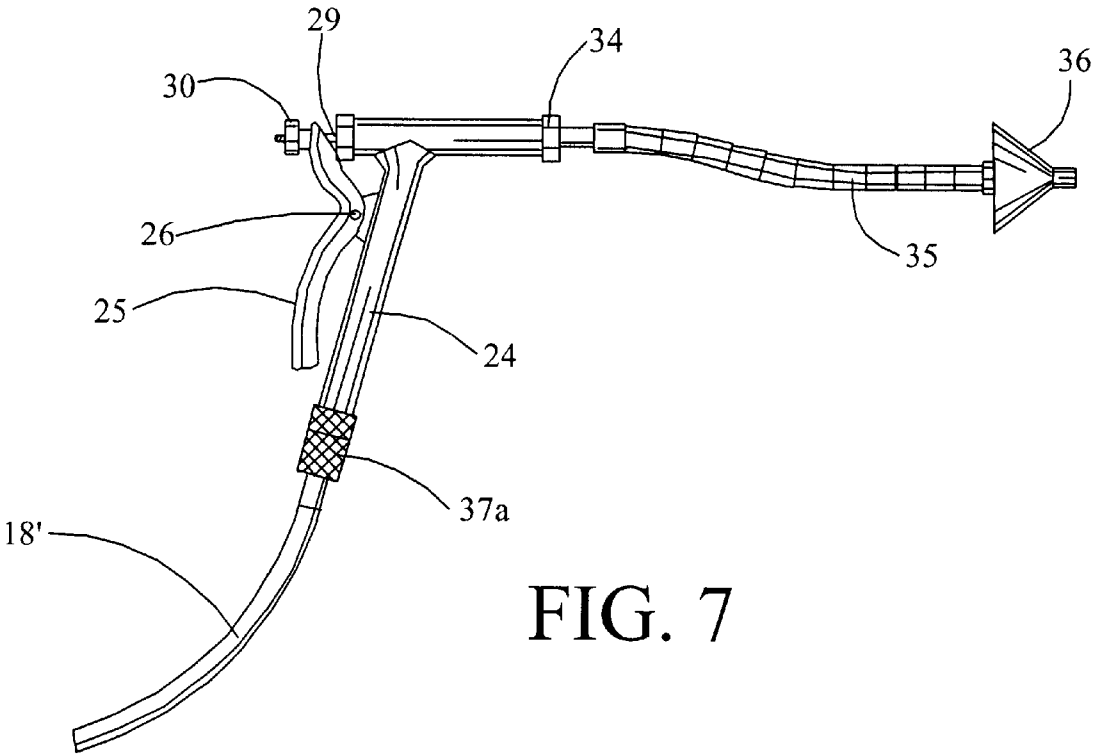
FIG. 7 is a side view of a fluid injection gun applicator taken from the right side.
Figure 8:
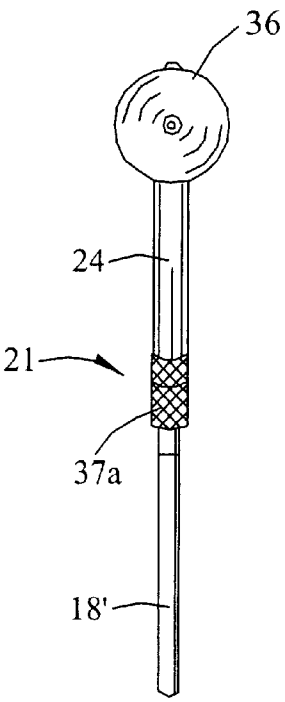
FIG. 8 is a front plan view of the fluid injection gun applicator.
Figure 9:
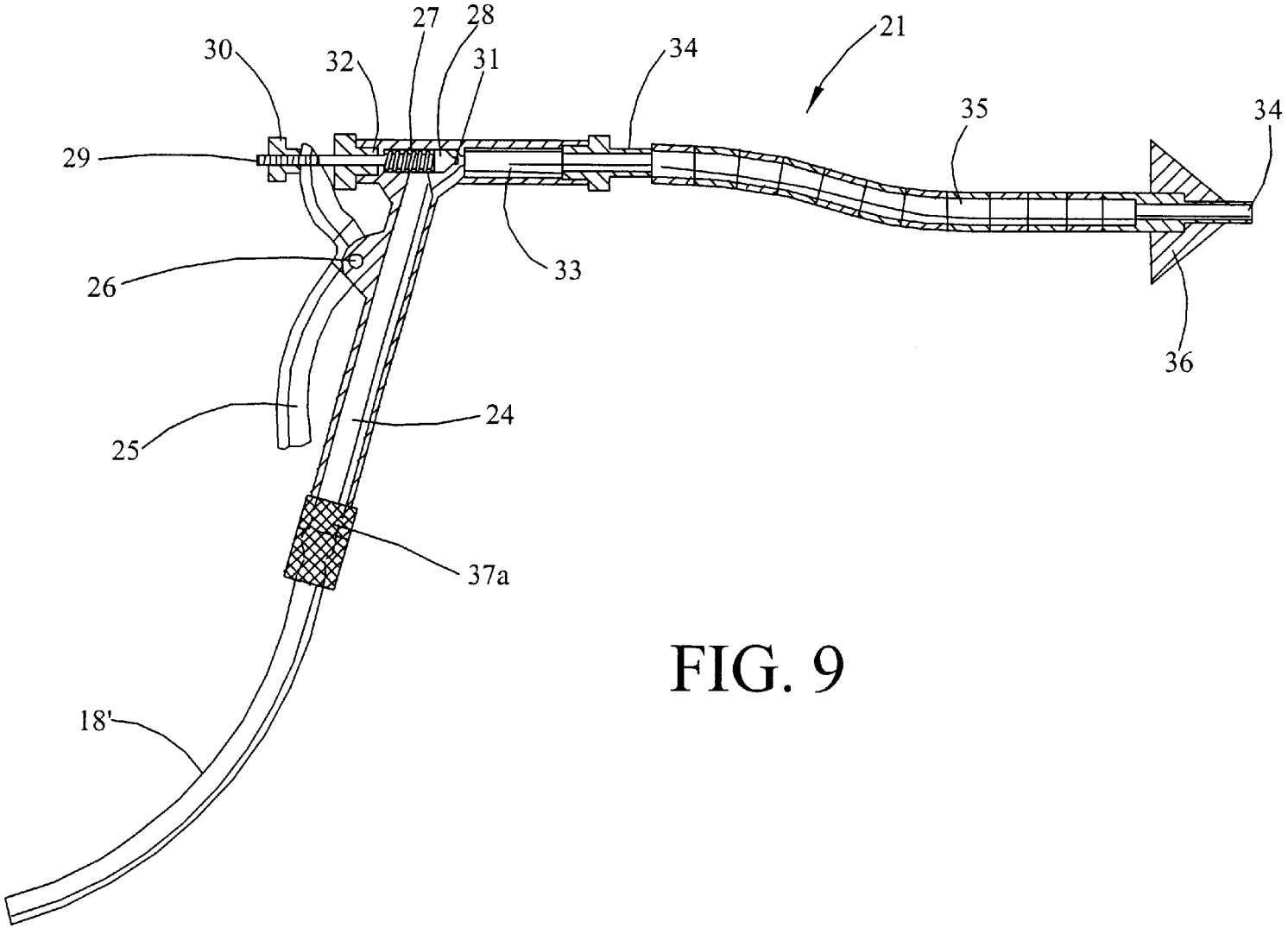
FIG. 9 is a cross-sectional view of the fluid gun applicator taken along line 9—9 in FIG. 6.

The components and manner of functioning of gun applicator 21 are described with particular reference to FIGS. 7 and 9, FIG. 9 being a cross-sectional view of applicator 21 taken along line 9—9 in FIG. 6.

Extending from the top rear of gun handle 24 is a gun lever 25 and a lever pivot 26. According to the embodiment depicted in FIG. 9, lever 25 is loaded using an internal return spring 27. Lever 25 can, alternatively, be externally spring loaded to provide similar functionality and results. Lever 25 engages a valve head 28 through a valve rod 29 which extends rearward from valve head 28. Rod 29 is threaded to receive an adjusting nut 30. Adjusting nut 30 acts as a stop to engage and flexibly secure the top of lever 25 to rod 29.

When injection gun 21 is not engaged, spring 27 presses valve head 28 against a valve seat 31 to close the entrance of an accumulation chamber 33. Accumulation chamber 33 terminates in a gun nozzle 34. Chamber 33 and nozzle 34 can be used alone or together with a semi-rigid but flexible tip hose 35. Tip hose 35 acts to further enhance the pulse of fluid that is ejected out of gun applicator 21.

A conical shaped sealing adaptor 36, fabricated from relatively soft, compressible material, can be mounted on the end of nozzle 34 or, as in accordance with the preferred embodiment depicted in FIGS. 6 through 9, to the end of tip hose 35. Sealing adaptor 36 functions to seal the entry of pipes and tubing, allowing the user to impart pressure within a matrix of pipes or tubes to better unclog or otherwise service such pipes and tubes.

Injection gun applicator 21 is energized by depressing the bottom of lever 25 relative to handle 24. Lever 25 pivots about pivot 26, causing the top of lever 25 secured by stop nut 30 to pull rod 29 rearward, withdrawing valve head 28 from valve seat. Withdrawing valve head 28 opens the entrance to accumulation chamber 33, allowing the pressurized gas or liquid fluid to escape through chamber 33 and nozzle 34.

Figure 10:
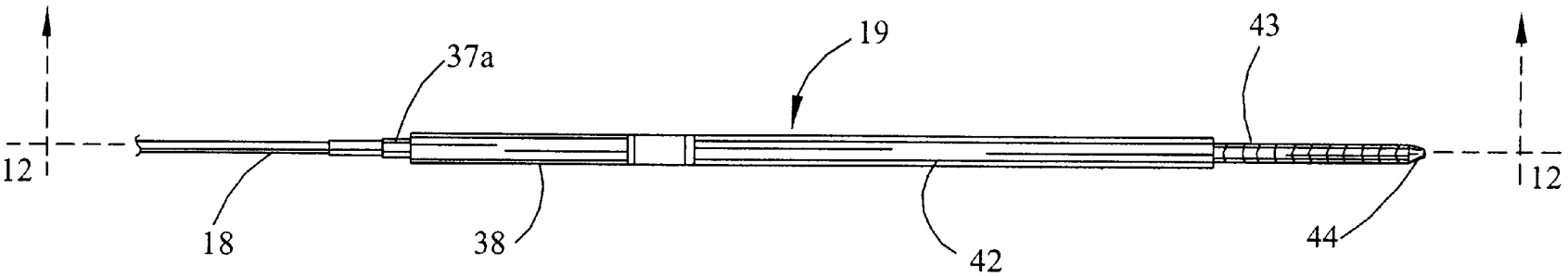
FIG. 10 is a top plan view of the sprayer wand applicator of the present invention.
Figure 11:
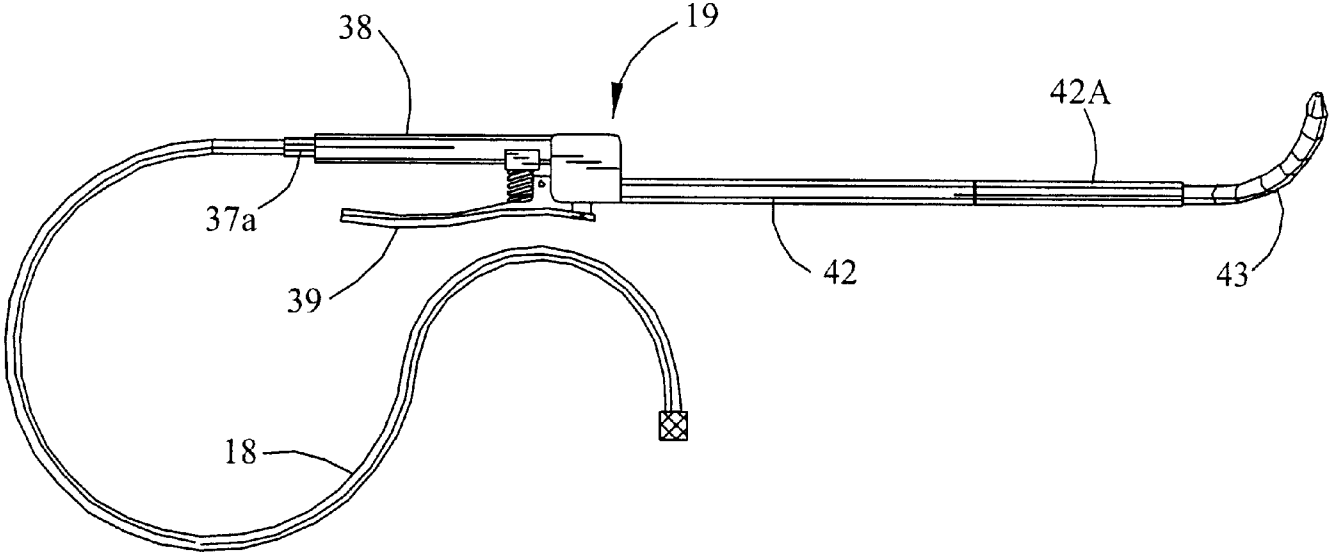
FIG. 11 is a side view of the sprayer wand applicator of the present invention taken from the right side.
Figure 12:
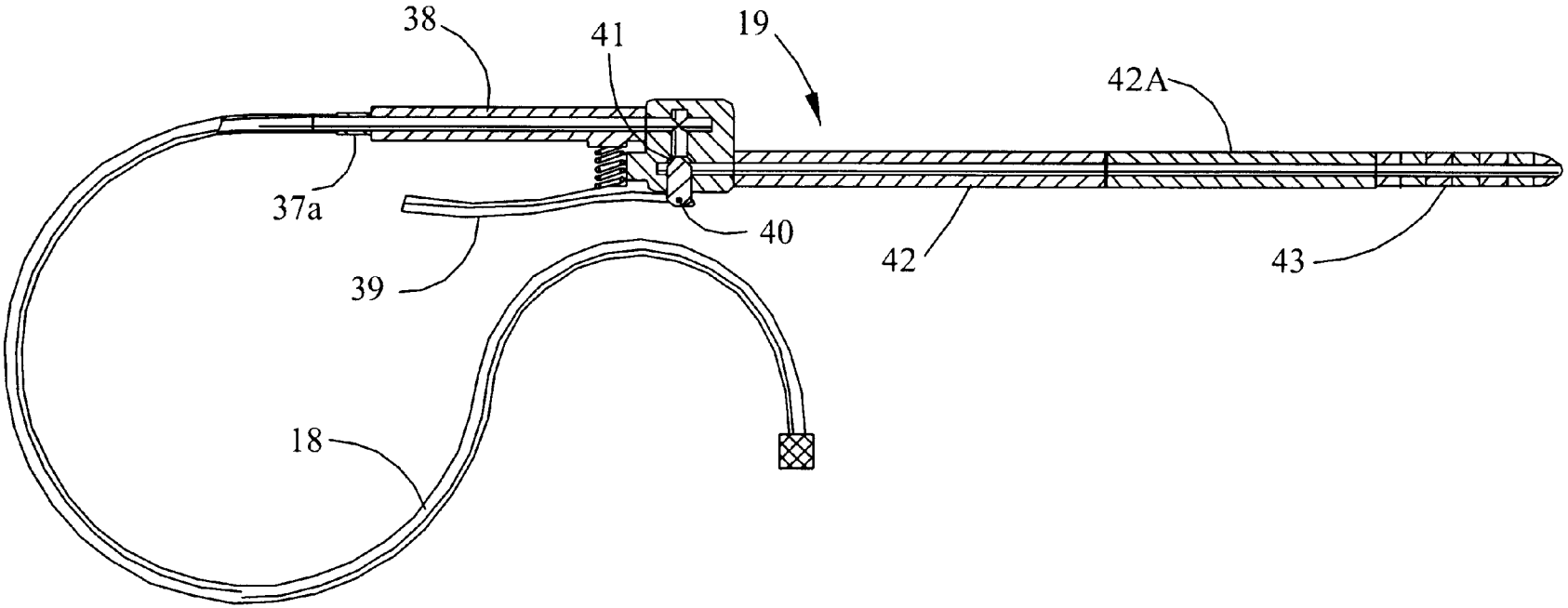
FIG. 12 is cross-sectional view of the sprayer wand applicator of the present invention taken along line 12—12 in FIG. 11.

Details of a preferred embodiment of sprayer wand applicator 19 are described with reference to FIGS. 10 through 12. To the base of sprayer applicator 19 is removably coupled hose 18 via inlet quick release fitting 37*a*. Inlet fitting 37*a* is secured to a sprayer body 38. A sprayer actuator 39 is pivotally mounted on body 38 and communicates with a sprayer valve 41 through an actuator linkage 40. Extending from the distal end of sprayer body 38 is a wand tube 42, one or more optional wand extension tubes 42A that function to reversibly extend the overall length of wand applicator 19, a stiff-flexible tip segment 43, and a sprayer nozzle 44. Tube 42, optional extension tubes 42A, stiff-flexible tube segment 43, and sprayer nozzle 44, can engage one another through threaded connections, quick release couplers, snap connections, or other commercially available connection methods.

Detailed Description of the Operation of the Multi-Mode Fluid Injection System The method of operation and use of the multi-mode fluid injection system of the present invention is described below with reference to FIGS. 1 and 5.

Screw cap 15 is removed together with the hand pump from tank 1 and a liquid, typically water or a cleaning solution of some sort, is introduced into tank aperture 2 to only partially fill the chamber of tank 1. Cap 15 is replaced and screwed tight, securing the hand pump within tank 1. Handle 14 is then pumped to pressurize tank 1 and its contents. An optional pressure gauge, not shown, can be used to determine when sufficient internal pressure has been attained.

Next an applicator, as for example either injection gun applicator 21 or wand sprayer applicator 19, is coupled to either air port 3 or liquid port 4 via hoses 18 or 18' and quick release fittings 37*a* and 37*p*. If port 3 is selected, the pressure in tank propels air through port 3 and hose 18 to the selected applicator. If the applicator is instead coupled to port4, the pressure in tank 1 propels the liquid stored at the bottom of tank 1 through port tube 5, port 4, and hose 18 to the selected applicator.

Applicators can be coupled concurrently to air 3 and liquid port 4, allowing the user to dispense, alternatively, pressurized liquid and gas without having to decouple and re-couple applicators. Two gun applicators 21, or two sprayer applicators 19, can be connected to ports 3 and 4, or gun applicator 21 or sprayer applicator 19 can be used in combination with other commercially available applicators, and so on.

Pressure levels within tank 1 are kept to safe values with relief valve 20. Total stored energy is a function of the pressure and the liquid level, which determines the amount of compressible gas within tank 1. With hose 18 connecting tank 1 to gun applicator 21 or sprayer applicator 19, the stored energy in tank 1 is made available at the gun or sprayer release valve.

The method of operation and use of the injection gun applicator 21 of the present invention is described below with reference to FIGS. 7 and 9.

The preferred routing of hose 18' is through the bottom of gun handle 24 as this facilitates a balanced gun design.

Handle 24 can have molded ergonomic finger slots (not shown.) and lever 25 is contoured to facilitate grasping. Gun release valve 28 is a high flow type and requires relatively small amount of lift to attain a high flow position. The travel can be made adjustable in order to fine tune the valve travel/speed.

As soon as lever 25 and handle 24 are compressed, the pressurized liquid or gas is propelled out of the tank and rushes to exit the specialized nozzle 34. Integral to gun applicator 21 is accumulation chamber 33 between valve head 28 and the exit nozzle 34. Chamber 33 functions as an inline accumulator, introducing a small delay in the "firing" of the gun valve and facilitating a measured level of pressure build up before the liquid or gas shoots out of the gun applicator. In an effort to keep size small but still increase the build up of pressure, an alternate nozzle located at a greater distance from valve head 28 can be used.

Accordingly, it will be readily appreciated that the injection gun applicator 21 of the present invention provides a unique method of introducing a narrow but high level pulse of pressurized liquid or gas to the inside of a target tube or the outside of a fin using only a light weight hand pump. The pulse produced by the small travel/high flow valve of gun applicator 21 can be fine tuned over a wide range by selecting gun nozzles 34 of varying shapes and diameters and by locating nozzle 34 at different locations relative to valve head 28.

The transfer of pressure from tank 1 to the point of delivery is further facilitated through the use of semi rigid—yet flexible—tip hose 35, capped by sealing adaptor 36. The conical shape of sealing adaptor 36 serves to engage a variety of pipe and tube openings without complicated mechanisms. Tip hose 35 is sufficiently flexible so that it may be bent to a specific shape to access and accommodate the target pipe, while sufficiently rigid to maintain its shape and prevent it from backing out of the target pipe or tubing when under pressure. If the required pressure is high, the sealing cone 36 can also be used to hold nozzle 34 in place within the target pipe or tube. The results of the quick pressure pulse from gun applicator 21 are effortless unclogging of pipes and forceful application of cleaning solution over fins, radiators and like components.

In the context of sprayer wand applicator 19, stiff-flexible tube segment 43 allows applicator 19 to be adjusted nearly 360 degrees axially as well as radially. This directional versatility, when combined with the length versatility achieved through the use of optional extension tubes 42A, render applicable 19 capable of reaching the most remote aspects of difficult to reach equipment.

When the fluid injection system of the present invention is not in use, being transported or stowed, hoses 18 are wound around tank 1 layered between tank 1's sidewalls and base extension 17 keeping the system compact and the hoses out of harms way.

Summary and Scope

Accordingly, it will be readily appreciated that the multi-mode fluid injection system of the present invention provides a portable, light weight apparatus which obviates the need for consumable pressure cartridges or heavy air compressors. The system's portability is further enhanced through the availability of built in hose stowage means. Applicators are easily interchanged, by means of hose quick disconnects, between tank ports. And importantly, because the system allows the user to apply pressurized gas or liquid through a single compact apparatus and without the need to empty or fill the apparatus, the job of the field worker is additional facilitated.

The multi-mode fluid injection system of the present invention fills a range of needs with great success. It addresses the various requirements for blow off, dislodging and spraying heat exchanger coils, pipes, tubes and other equipment, internally and externally. Among the specific applications are spraying coils, fins and other equipment with a cleaning solution; cleaning coils, fins and other equipment with blasts of air; unclogging internal blockages in small, medium and even large pipes and tubes and other equipment with powerful blasts of air.

The disclosed and claimed system is a very important addition to a service van as it reduces the need for an independent power source like an air compressor. The small size allows for easy transport on roof tops where air conditioning equipment are frequently located and simplifies the cleaning process dramatically. This in turn increases the quality of service, which saves energy and money for all concerned.

Although the description above contains many specifications, these should not be construed as limiting the scope of the invention but merely providing illustrations of some of the presently preferred embodiments thereof. By way of example and not limitation, applicators other than injection gun 21 and wand sprayer 19 may be employed in the multi-mode system of the present invention without departing from the invention's scope or essential intent. Similarly, although the hand pump described and depicted is removably secured within aperture 2 of tank 1 by screw on cap 15, tanks having hand pumps permanently built into tank 1 and a filling cavity separate and apart the hand pump can be employed without departing from the intent or spirit of the subject invention. Other equivalents of the claimed invention include tanks having upper and lower ports formed in its sidewalls, and tanks with more than two outlet ports.

Thus the scope of the subject invention should be determined by the appended claims and their legal equivalents, rather than by the specific examples given above.

The embodiments of the invention in which an exclusive property or privilege is claimed are defined as follows:

1. A multi-mode fluid injection system comprising a single chamber tank, an aperture for introducing liquid and gas contents into said tank, a pump means to supply said liquid and gas contents of said tank with pressure, a first port allowing access to the gas phase contents located in upper portion of said tank, a second port allowing access to the liquid phase contents located in the lower portion of said tank, one or more applicators, and flexible hoses which connect said applicators to said ports, wherein said hoses with applicators may be attached to one, the other, or both of said ports and wherein said hoses supply said applicators, alternatively, with the tank's gas and liquid contents when said contents are under pressure.

2. The fluid injection system of claim 1 wherein both the first and second ports are formed in the top of said tank and a tube extends downward from the bottom of said second port to access the liquid phase contents located in the lower portion of said tank.

3. The fluid injection system of claim 1 wherein said pump means is a hand pump removably secured within the top of said tank and wherein said aperture for introducing liquid and air contents into said tank is the opening exposed in the top of said tank when said hand pump is removed.

4. The fluid injection system of claim 1 wherein said tank further comprising an onboard means for stowing said supply hoses when said system is not in use.

5. The injection system of claim 4, wherein said means for stowage comprises a concave lip that projects outward and upward from the base of said tank and whereby said concave lip functions as a secondary reservoir against tank leaks and spills while promoting tank stability when the system is in use.

6. The injection system of claim 5 wherein said concave lip has a flat side to facilitate said tank being laid on its side during storage and use.

7. The fluid injection system of claim 1 further comprising a relief valve built into said tank.

8. The fluid injection system of claim 1 wherein said applicator is an injection gun having an accumulation chamber capable of producing high pressure pulses of liquid or gas.

9. The fluid injection system of claim 1 wherein said applicator is an injection gun having a small travel-high flow valve.

10. The fluid injection system of claim 9 wherein said injection gun having a small travel-high flow valve further comprises an inlet conduit, a means for actuating said valve, an accumulation chamber, and a nozzle, wherein said inlet conduit terminates at said valve, said valve forms the entrance of said accumulation chamber, and said nozzle forms the exit of said accumulation chamber, and whereby said high velocity pulses of fluid exit said nozzle when pressurized fluid is introduced into said inlet conduit and said valve is actuated.

11. The fluid injection system of claim 1 wherein said applicator has a stiff-flexible tip.

12. The fluid injection system of claim 1 wherein said applicator comprising a fluid inlet, a body, a valve, a means for actuating said valve, a nozzles, and a stiff-flexible tip secured to and extending from said nozzle.

13. The fluid system of claim 12 wherein said applicator further comprises a conical sealing adaptor attached to the end of said stiff-flexible tip disposed with base facing said applicator.

14. The fluid injection system of claim 1 wherein said applicator has a length adjustable tip comprising a plurality of stiff-flexible tubes detachably coupled to one another.

15. The fluid injection system of claim 1 wherein said applicator further comprises a conical sealing adaptor attached to the end of said applicator disposed with base facing said applicator.

16. The fluid injection system of claim 1 wherein said applicator is a wand sprayer.

17. A fluid injection system comprising a tank having at least one port allowing access to the tank's contents, a means for introducing fluid into said tank, a pump means to supply said tank contents with pressure, one or more applicators, flexible hoses which connect said applicators to said ports and serve to supply said applicators with the tank's contents when said contents are under pressure, and a concave lip that projects outward and upward from the base of said tank, whereby said lip function as a secondary reservoir against tank leaks and spills while increases tank stability when the system is in use, and whereby said lip function as an onboard means for stowing said supply hoses when said system is not in use.

18. The injection system of claim 17 wherein said concave lip has a flat side to facilitate said tank being laid on its side during storage and use.

* * * * *